United States Patent [19]

Johansson et al.

[11] Patent Number: 4,785,789

[45] Date of Patent: Nov. 22, 1988

[54] METHOD AND SYSTEM FOR CONTROLLING THE SPARK IGNITION OF IGNITION ELEMENTS IN AN INTERNAL COMBUSTION ENGINE

[75] Inventors: Hans Johansson; Jan Nytomt, both of Åmål, Sweden

[73] Assignee: Saab-Scania Aktiebolag, Sweden

[21] Appl. No.: 143,137

[22] PCT Filed: May 13, 1987

[86] PCT No.: PCT/SE87/00238

§ 371 Date: Jan. 7, 1988

§ 102(e) Date: Jan. 7, 1988

[87] PCT Pub. No.: WO87/06979

PCT Pub. Date: Nov. 19, 1987

[30] Foreign Application Priority Data

May 14, 1986 [SE] Sweden ..... 8602182

[51] Int. Cl.[4] ..... F02P 3/06

[52] U.S. Cl. ..... 123/596; 123/597

[58] Field of Search ..... 123/596, 597, 640, 602, 123/620, 630, 618, 605, 637, 479

[56] References Cited

U.S. PATENT DOCUMENTS 4,245,609 1/1981 Garry ..... 123/596
4,273,093 1/1981 Ozawa ..... 123/602
4,445,491 5/1984 Ishikawa et al. ..... 123/596
4,462,363 7/1984 Nanjyo et al. ..... 123/602
4,515,140 5/1985 Enomoto et al. ..... 123/596
4,610,237 4/1986 Ionesca et al. ..... 123/602
4,633,834 1/1987 Takeuchi et al. ..... 123/602
4,672,941 6/1987 Yamagata ..... 123/602

*Primary Examiner*—Raymond A. Nelli

*Attorney, Agent, or Firm*—Ostrolenk, Faber, Gerb & Soffen

[57] ABSTRACT

Disclosed is a method and system for controlling, in a multi-cylinder four-stroke internal combustion engine, the spark ignition in at least two cylinders, the pistons of which simultaneously assume a top dead center position. The method and system achieve a more reliable start with low supply voltage. For this purpose, the charging and discharging of an ignition capacitor is controlled by a control unit in such a way that, when the pistons in a pair of cylinders pass through the same crankshaft angle range close to the top dead center position, ignition is generated in first one and then the other of the pair of cylinders. Between the times for generating the ignition, the ignition capacitor is charged as a function of supply voltage so that a full charge is utilized for generating the ignition sparks in the cylinders.

16 Claims, 2 Drawing Sheets

METHOD AND SYSTEM FOR CONTROLLING THE SPARK IGNITION OF IGNITION ELEMENTS IN AN INTERNAL COMBUSTION ENGINE

BACKGROUND OF THE INVENTION

The present invention relates to a method and system for controlling the spark ignition of spark plugs, in the ignition system of a multi-cylinder four-stroke internal combustion engine.

The present invention has particular application for controlling the spark ignition in at least two cylinders of the foregoing type of engine, wherein the pistons of such cylinders simultaneously assume a top dead center position, and wherein an ignition capacitor operates in conjunction with at least two discharging circuits and one charging circuit. The discharging circuits each comprise, in series, a primary winding of an ignition coil and a first circuit breaker element which can be switched from an electric control unit. The charging circuit supplied with current from a direct-current source, comprises a coil in series with a second circuit breaker element which can be switched from the control unit.

An engine as specified above can comprise, for example, a four-cylinder Otto-cycle engine in which the electric control unit included in the ignition system replaces a conventional mechanically controlled ignition distributor. Some of the electric control unit lacks a cam shaft transmitter, it is not possible to initially determine which cylinder is the first one to be in firing position. To ensure that ignition voltage is generated in the cylinder which is in firing position, it is suggested to allow the control unit to trigger ignition at the same time in two or all cylinders as soon as the signal from a crank shaft transmitter indicates that the pistons in a pair of cylinders assume the top dead centre position. In this arrangement, the charge of the ignition capacitor is utilized for simultaneous ignition in two or more cylinders and, as a result, only half or less than half of the charge of the ignition capacitor is used for generating ignition sparks in a cylinder.

If the voltage of the direct-current source drops due, for example, to low environmental temperatures, special starting problems occur with engines of the type just described. Thus, a low source voltage can result in the control unit not being able to properly control the charging processes occurring during a starting procedure.

Through German Patent Specification No. 2 448 302, a method and system are already known for assuring, during the start of an internal combustion engine, the charging of an ignition capacitor even with a decreasing battery voltage. But this does not teach how to arrange the charging and discharging of the ignition capacitor to obtain a more reliable ignition when starting an engine of the type as specified above.

SUMMARY AND OBJECTS OF THE INVENTION

A principal object of the present invention is to provide a method and system for obtaining a more reliable ignition for the type of engine specified above.

In achieving the foregoing object, the invention provides that when the pistons of the above-mentioned cylinders pass through the same crankshaft angle range close to the top dead centre position, a control unit emits first through fourth signals. The first signal is to the circuit breaker element of a first discharging circuit for triggering ignition in one of the above-mentioned cylinders. The second signal is to the second circuit breaker element for starting current supply to a charging circuit, which may include a coil. The third signal is also to the second circuit breaker element for interrupting current supply to the charging circuit, the ignition capacitor being charged with the energy stored in the coil. The fourth signal is to the circuit breaker element of a second discharging circuit for triggering ignition in the second one of the above-mentioned cylinders. Between the second and third signals the charging circuit is energized for a first time period, and between the respective ignitions of the first and fourth signals there runs a second time period which exceeds the first time period.

By means of the invention the ignition voltage can thus be generated for the cylinder pair in such a manner that, within a limited crankshaft angle range before the top dead centre position of the pistons, the ignition sparks in the cylinders can occur at separate times. The complete charge of the ignition capacitor can thus be fully utilized at a first point of time for ignition in one of the cylinders. After being charged again to full charge during the first period of time, the discharging of the ignition capacitor can then be fully utilized for ignition in the other cylinder at a second point of time. Compared with the solutions described above, much stronger ignition sparks are thus obtained for igniting the combustion air mixture which is present in at least one of the cylinders of the pair of cylinders. As a result, more reliable cold starts of the engine are assured.

In a preferred embodiment, the voltage level of the direct current source is detected and a signal corresponding to it is supplied to the control unit which, below a predetermined voltage level, controls the first time period a function of such voltage level.

This makes it possible to adapt the time between discharges to the available voltage level. Thus, a longer time for charging the ignition capacitors is allowed when a lower voltage level is available than when the voltage level corresponds to a fully charged battery.

The present invention also provides a system for carrying out the method according to the invention. The system comprises a multi-cylinder ignition system for an Otto-cycle engine wherein the pistons of of at least two cylinders simultaneously assume a top dead centre position. The system includes an ignition element in each cylinder, at least two ignition coils each with a secondary winding electrically connected to a respective ignition element, and at least one ignition capacitor. Such capacitor is electrically connected, on the one hand, to a discharging circuit for each ignition coil, which circuit comprises a primary winding of the ignition coil connected in series with a first circuit breaker element, and, on the other hand, to a charging circuit which comprises a coil and a second circuit breaker element connected in series with each other. The system includes means to connect a direct-current source to the charging circuit and a control unit electrically connected to the foregoing circuit breaker elements for controlling them.

The system of the invention further comprises elements for detecting the direct-current source voltage level and supplying to the control unit a signal corresponding to such voltage level. The control unit, in conjunction with a timing unit, supplies signals, which are separate in time and are dependent on the foregoing voltage level, to the circuit breaker elements when the same crankshaft angle range, close to the said top dead centre position of the pistons, is passed through by the pistons.

BRIEF DESCRIPTION OF THE DRAWINGS

Other features of the invention are apparent from the attached claims and the following description of an embodiment exemplifying the invention. The description is given with reference to the attached figures, in which:

DESCRIPTION OF THE PREFERRED EMBODIMENTS

Figure 1:
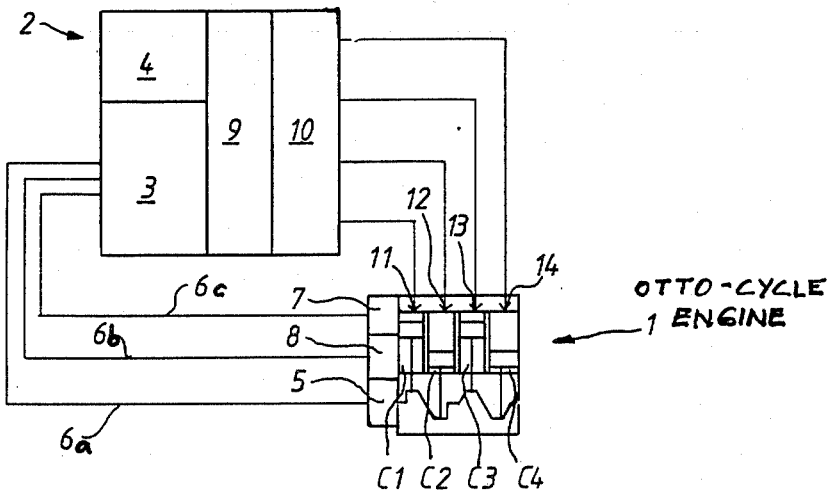
FIG. 1 shows a block diagram of the arrangement according to the invention.

FIG. 1 shows how a signal is supplied from a crankshaft transmitter 5 attached to an Otto-cycle engine 1 via lines 6*a*, 6*b* and 6*c* to a microcomputer-controlled ignition system 2 controlling the ignition of the engine. System 2 includes a control unit 3 in which a microcomputer 3′, shown in a dashed-line box, calculates the point of time for the ignition in the respective cylinder on the basis of incoming data from the crankshaft transmitter 5, an intake pressure transmitter 7, an engine temperature transmitter 8 and any other transmitters. The ignition system 2 is of the capacitive type and also comprises a charging circuit 4, discharging circuits 9 and ignition circuits 10 for spark plugs 11–14 of the respective cylinders C1, C2, C3, C4 in the Otto-cycle engine 1.

The cylinder C1–C4 are divided into cylinder pairs C1, C3; C2, C4, in which a pistons run parallel in the known manner but with a phase difference of 360 degrees of crankshaft angle. Hereinafter such phase difference is simply stated in degrees.) When the piston in one cylinder C1 in the cylinder pair C1, C3 starts a compression stroke of a four-stroke cycle, the piston of the second cylinder C3 is in the exhaust stroke. The pistons of one cylinder pair C1, C3 however run with 180 degrees difference relative to the pistons of the second cylinder pair C2, C4 which means that when the pistons of one cylinder pair C1, C3 are in the top dead centre position, the pistons of the second cylinder pair C2, C4 are in the bottom dead centre position.

Figure 2:
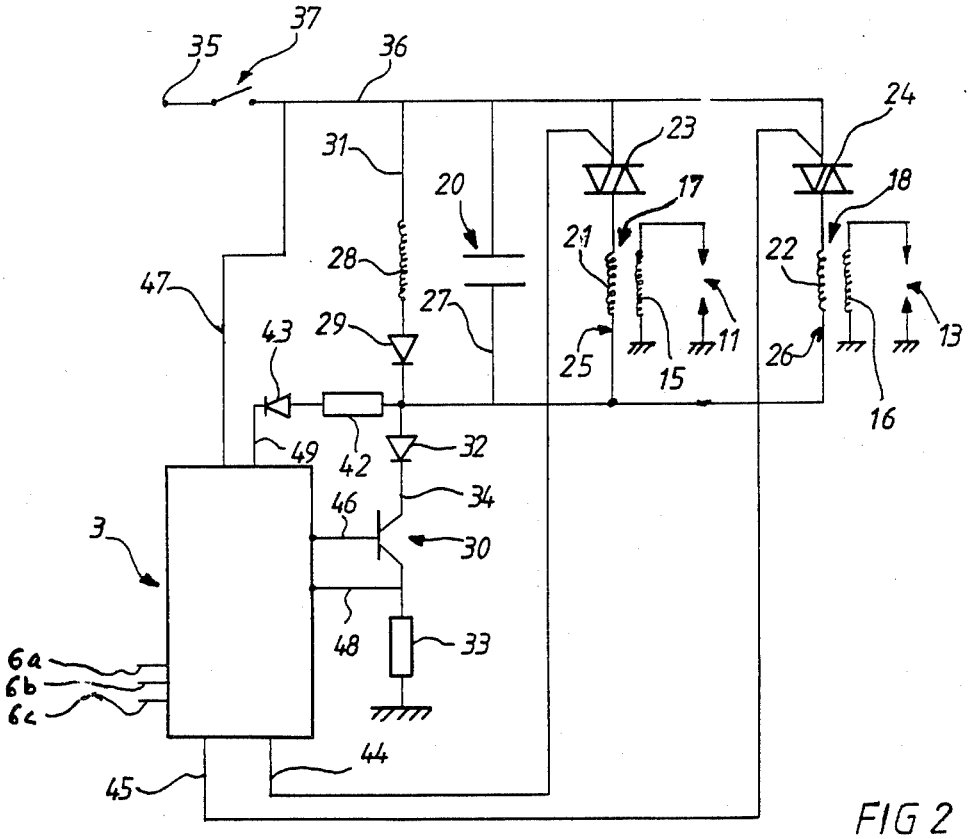
FIG. 2 shows a basic circuit diagram of the arrangement according to the invention.

FIG. 2 shows those parts of the ignition system 2 of FIG. 1 which are essential for describing the present invention. Only the spark plugs 11 and 13 of the spark plugs 11–14 in FIG. 1 are shown in FIG. 2. The spark plugs 11 and 13 are shown diagrammatically, each connected to a respective associated secondary winding 15, 16 of a corresponding number of ignition coils 17, 18. The primary windings 21, 22 of the ignition coils 17, 18 are each series-coupled to associated circuit breaker element 23, 24, here constructed as triacs. Each primary winding 21, 22 and associated triac 23, 24 constitutes a discharging circuit 25, 26 which is coupled in parallel with an ignition capacitor 20 in a line 27. A coil 28 is similarly coupled in parallel with the ignition capacitor 20; this coil, which is referred to as "choke" hereinafter, is coupled in series with a diode 29 in a line 31. Line 27 with the ignition capacitor 20 and all lines 25, 26, 31 coupled in parallel therewith are connected at one end to a second circuit breaker element 30, series-connected to a second diode 32 and a resistor 33 in a line 34, and at the other end to a direct-current source 35, preferably a 12 V batter via a line 36 including an ignition key circuit breaker 37. Circuit breaker element 30 may be a transistor, for example. Diodes 29, 32 are arranged in such a manner that when the transmitter 30 is conductive, current can be fed from the battery 35 through the lines 31, 34 to earth.

Triacs 23, 24 and transistor 30 are controlled by means of signals on lines 44, 45 and 46 from control unit 3. Control unit 3 is supplied with, in addition to the input signals specified in FIG. 1 on lines 6*a*–6*c*, an input signal representing the voltage level on the battery 35 on a line 47. A line 48 connects control unit 3 to line 34 between transistor 30 and resistor 33 and transfers a potential corresponding to the charging current to control unit 3. In addition, control unit 3 also obtains information about the potential of ignition capacitor 20 via a line 49 with a resistor 42 and a diode 43.

In principle, the system according to FIG. 2 operates as follows.

During engine starting, circuit breaker 37 closes on line 36 and battery 35 delivers direct current via charging circuit 31, 34 through choke 28, diodes 29, 32, transistor 30 and resistor 33 to earth. Thus, control unit 3 keeps triacs 23, 24 nonconductive while transistor 30 is made to conduct. When the charging current and a potential corresponding thereto on line 48 have reached a predetermined level, control unit 3 interrupts the current through transistor 30. Energy stored in choke 28 is thereby transferred to capacitor 20 which is thus charged. If control unit 3, on the basis of the input signals on lines 6*a*–6*c* and 41 subsequently supplies an output signal to, for example, the triac 23 at the ignition time determined in control unit 3, triac 23 conducts and ignition capacitor 20 discharges through primary winding 21. This causes an ignition voltage to be generated in secondary coil 15 which is followed by the generation of an ignition spark at spark plug 11. The potential of ignition capacitor 20 is sensed by control unit 3 via line 49 and when it has fallen below a predetermined value, control unit 3 starts a new charging cycle by providing, on line 46, an output signal to transistor 30 for making the latter conduct. At the same time, triac 23 stops flow in line 25. In the same manner as above, control unit 3 then again manages the charging and discharging of ignition capacitor 20.

Figure 3:
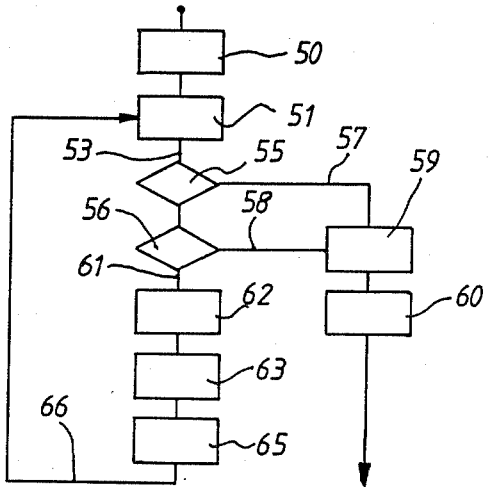
FIG. 3 shows a flow chart for a method according to the invention.

According to the present inventive method, control unit 3 controls the ignition on engine start in accordance with a starting program stored in its micro-computer which is explained in accordance with the flow chart shown in FIG. 3.

The program in FIG. 3 starts with an operation step 50 in which pulses of the output signal of crankshaft transmitter 5 are derived in a manner known per se from cylinder pairs C1, C3 and C2, C4, respectively. Such pulses for transmitters, relating to a respective cylinder pair, recur with a spacing of 180 degrees and have a distance corresponding to, for example, 35 degrees between a first, negative edge and a second, positive edge. In a subsequent operational step 51, the next 180 degree pulse, for example relating to cylinder pair C1, C3, is awaited. When the negative edge of the pulse is detected, the program follows a flow line 53 to an inquiry step 55 where it is determined whether the speed of the engine is less than or greater than, for example, 400 rpm.

This a criterion for whether the engine has left the starting process or not. If the engine speed is below said limit, the program continues to an inquiry step 56 where it is determined whether the battery voltage is less than or greater than, for example, 11 V. Such voltage limit is used as a criterion for possible starting problems in cold weather.

If either the engine speed exceeds or is equal to 400 rpm or the battery voltage exceeds or is equal to 11 V according to inquiry steps 55, 56, the program proceeds via flow lines 57 and 58, respectively, to an operation step 59 where at the same time the ignition is generated in both cylinders C1, C3. Operation step 59 is followed by an operation step 60 where it is determined whether ignition occurs in cylinder C1 or C3. This can be done by means of an ionizing current arrangement of the type which is shown in Swedish Pat. No. 8406457-5. From the information about the ignition in either cylinder, the control unit determines the ignition sequence of the engine which is the end product of the starting program. This forms the basis for continued control of the engine ignition by control unit 3.

However, if both the engine speed is below 400 rpm and the battery voltage is below 11 V, the starting program follows a flow line 61 to an operation step 62. There, the control unit provides an output signal to the triac in the discharging circuit 25 of one cylinder, for example C1, where the positive edge of the 180-degree pulse is detected. This preferably arrives approximately 15 degrees before the top dead centre position of the piston pair, whereby an ignition voltage is generated for spark plug 11 in cylinder 1.

After that, the program continues to an operation step 63 in which control unit 3 determines and waits for a predetermined time by controlling a signal for transistor 30 in such a manner that it conducts and starts a new charging cycle in the manner described above with reference to FIG. 2. The duration of the charging cycle (charging time) is determined by the onset of a signal of control unit 3 to transistor 30 for making it conduct and the time at which the ignition capacitor is charged. The latter time occurs almost immediately afterwards, for example a few ms after the control unit has emitted a signal to transistor 30 for stopping conduction. The charging times vary in dependence on the battery voltage level in such a manner that, the lower the battery voltage, the longer the charging time.

The predetermined time which control unit 3 waits at operation step 63 is as long as the charging time where control unit 3 is designed in such a manner that it can determine via a signal on line 49 when ignition capacitor 20 is charged. If control unit 3 is not capable of reading this information from such signal on line 49, the predetermined time is determined with the help of tables stored in control unit 3 or a similar device. Thus, different times are selected in dependence on the battery voltage level, and the time control unit 3 waits at operation step 63 varies, with advantageously close matching to the charging time, from 6 ms at a battery voltage of 11 V up to 12 ms or at least less than 15 ms with a battery voltage of 5 V. At the prevailing starter motor speed, the foregoing times correspond to between approximately 2 and 10 degrees rotation of the crankshaft.

After the waiting time at step 63 determined by control unit 3, the program continues to operation step 65 where control unit 3 makes triac 24 conduct via a signal on line 45. This results in ignition capacitor 20 being discharged through primary winding 22. A corresponding generation of ignition voltage in secondary coil 16 results in the formation of an ignition spark at spark plug 13 in cylinder C3. From operation step 65, a flow line 66 leads back to operation step 51 where the next 180 degrees pulse from the crankshaft transmitter 5 is awaited. Such 180 degree pulse represents the second cylinder pair C2, C4 and when the negative edge of the pulse is detected, the starting program follows the flow diagram in the manner described above.

Thus, two ignition sparks separated in time can be formed in the cylinder pair concerned with an undercharged battery by means of the method according to the invention. This is done during the time the crankshaft passes through one and the same crankshaft angle range close to the top dead centre positions for the pistons of the cylinder pair. The time between ignition sparks is utilized for recharging the ignition capacitor after the first discharging so as to ensure a fully charged ignition capacitor for both instances of ignition.

Figure 4:
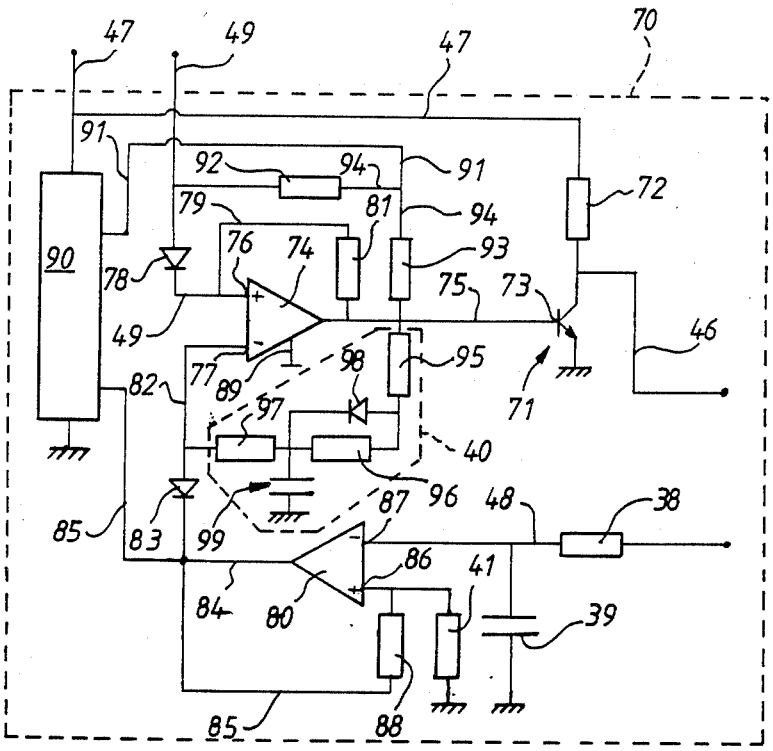
FIG. 4 exemplifies a circuit diagram for a timing unit incorporated in the invention.

In FIG. 4, an example is shown for an embodiment in which control unit 3 includes a timing unit 70 constructed as a combined circuit to control the switching of transistor 30 and, thereby, the charging time for ignition capacitor 20.

Line 46 reproduced in FIG. 2 is connected to the base of transistor 30. As is shown in FIG. 4, line 46 is also connected to the collector of a control transistor 71. Transistor 30 is nonconductive as long as control transistor 71 connects line 46 to earth. When control transistor 71 is not conducting, the base of transistor 30 receives a high potential via line 47, connected to battery 35, through a resistor 72, for matching the potential of transistors 30, 71.

Control transistor 71 conducts current with a high potential on its base 73 and consequently ceases conduction with a low potential at its base. The potential of base 73 is determined by a comparator 74, the output of which is connected to base 73 via line 75. Base 73 receives a high potential if the potential at the positive input 76 of comparator 74 exceeds the potential at its negative input 77. Line 49, shown in FIG. 2 with resistor 42 and diode 43, also includes diode 78 and leads to the positive input 76. Line 49 is connected to ignition capacitor 20 and the potential at the positive input 76 of comparator 74 thereby represents the voltage condition of ignition capacitor 20. A feedback line 79 with a resistor 81 between input 76 and the output of comparator 74 ensures a predetermined potential relation between such input and output. The negative input 77 of comparator 74 is connected by a line 82 including a diode 83 to the output 84 of a second comparator 80. If such output 84 is at low potential, input 77 of comparator 74 is also at low potential whereas, if output 84 is at high potential, input 77 is also at high potential for the most part.

Line 48, also shown in FIG. 2, includes a resistor 38 and leads to the negative input 87 of comparator 80. Thus, line 48 transfers to input 87 a potential which corresponds to that which prevails in charging circuit 34 between transistor 30 and resistor 33. The potential on line 48 is stabilized by a capacitor 39 connected to earth.

The positive input 86 of comparator 80 is supplied with a constant reference potential via a line 85, which includes a resistor 88 forming a voltage divider with a resistor 41 which is connected to earth. Line 85 receives voltage fed from a voltage stabilizer 90 which obtains low-voltage direct current from the battery 35 (FIG. 2) via line 47, shown in FIG. 2, and converts it to a stabilized 5 V voltage supplied on lines 85 and 91. The last-mentioned line 91 supplies 5 V between two resistors 92, 93 on a line 94 between line 49 and output 75 of comparator 74. A timing circuit 40, also connected to the negative input 77 of comparator 74, also leads to output 75. Timing circuit 40 includes three series-connected resistors 95, 96, 97, between input 77 and output 75 of comparator 74, and a diode 98 which is connected in parallel with the middle resistor whereby the diode allows current to flow from the output of the comparator to a capacitor 99 connected to earth between resistors 96, 97.

The timing unit 70 operates as follows. When the ignition is switched on, battery 35 delivers current via lines 46, 47 and provides a high potential at the base of transistor 30, which conducts and allows a current to flow through charging circuit 31, 34, shown in FIG. 2. The potential in charging circuit 31, 34 between transistor 30 and resistor 33 increases successively as does the potential at input 87 of comparator 80 via line 48. At the end or charging, the potential at input 87 exceeds the potential at input 86, which is at a constant level via line 85 from the voltage stabilizer. Output 84 of comparator 80 thus falls to a low voltage level and the potential at input 77 of comparator 74 also drops via line 82 and diode 83 and thereby falls below the potential at input 76. The latter is held at a fixed output level by being fed with voltage via line 91 from voltage stabilizer 90 and lines 94, 49 with resistor 92 and diode 78. Output 75 of comparator 74 goes to high potential which means, according to what is stated above, that transistor 30 stops conducting.

When transistor 30 is nonconductive, the electrical energy in choke 28 (FIG. 2) is transferred to ignition capacitor 20. Input 76 of comparator 74, and thus also output 75 of comparator 74, receives a high potential via line 49, which keeps transistor 30 in its nonconducting state.

When control unit 3 (FIG. 2) causes ignition capacitor 20 to discharge, the potential at input 76 of comparator 74 thereby drops below the level at input 77. Output 75 of comparator 74 goes to low potential which means that transistor 30 conducts and a new charging cycle is begun.

During the time in which ignition capacitor 20 waits to be discharged and output 75 of comparator 74 is at high potential, capacitor 99 located in timing circuit 40 is charged from voltage stabilizer 90 via line 91, resistor 93, and resistor 95 and diode 98 of timing circuit 40. When output 75 of comparator 74 goes back to low potential with the discharging of ignition capacitor 20, a discharging of capacitor 99 begins via resistors 96, 95 and an earth connection 89 in comparator 74. When the potential of capacitor 99 has dropped sufficiently, the potential at input 77 also drops via resistor 97. Thus, the potential at input 77 drops below the potential of input 76 and output 75 of comparator 74 goes back to high potential. This means that transistor 30 stops conducting followed by immediate transfer of the energy of choke 28 to ignition capacitor 20. Thus, a predetermined drop of the potential at input 77 of comparator 74 occurs with the help of timing circuit 40 until comparator 74 switches over and ignition capacitor 20 is again charged. By choosing the capacitance and resistances of timing circuit 40, a required value of the maximum charging time can be determined.

The value of charging time for ignition capacitor 20 can be, for example, up to 12 ms, which means that the above-mentioned limited maximum charging time is only utilized with low battery voltages, for example down to 5 V. Below this voltage level there is no limiting of the maximum charging time. With higher battery voltage, comparator 80 switches over, which, in turn, results in comparator 74 switching over and thus the ignition capacitor being charged within the said 12 ms period.

Thus, the conductive state of transistor 30 is controlled by the timing unit shown in FIG. 4 so that the charging time approaches the above-mentioned value at a maximum. This enables ignition capacitor 20 to be charged even with low battery voltages. Such charging occurs between the output signals of control unit 3 to the triacs of a cylinder pair for igniting first one and then the other cylinder at while the pistons of the cylinder pair pass through one and the same crankshaft angle range close to the top centre position.

Although the present invention has been described in connection with a plurality of preferred embodiments thereof, many other variations and modifications will now become apparent to those skilled in the art. For example, an ignition capacitor or similar can be considered to cover solutions including several parallel-connected ignition capacitors which functionally operate as a single capacitance. It is preferred, therefore, that the present invention be limited not by the specific disclosure herein, but only by the appended claims.

We claim:

1. An ignition system for spark ignition a multi-cylinder four-stroke internal combustion engine having at least two cylinders, pistons of which simultaneously assume a top dead center position, the system comprising:

an ignition capacitor;

an electric control means;

at least two discharging circuits each comprising, in series, a primary winding of an ignition coil and a first circuit breaker element which can be switched from the electric control means;

a charging circuit comprising a coil in series with a second circuit breaker element which can be switched from the control means and a means for connection to a direct current source; and the electric control means including means for producing first through fourth signals when the above-mentioned pistons pass through the same crankshaft angle close to the top dead center position, the first signal being sent to a respective first circuit breaker element of a first of the discharging circuits for triggering ignition in one of the above-mentioned cylinders, the second and third signals being sent to the second circuit breaker element for starting and interrupting, respectively, current supply to the charging circuit, and the fourth signal being sent to the first circuit breaker element of the second discharging circuit for triggering ignition in a second of the above-mentioned cylinders, the ignition capacitor being charged between the second and third signals during a first time period which is shorter than a second tme period between the first and fourth signals.

2. The system according to claim 1, wherein the control means includes means to detect the voltage level of the direct current source and, when such level is below a predetermined value, to vary the first time period as a function of such voltage level.

3. The system according to claim 2, wherein the control means increases the first time period with decreasing voltage level of the direct current source when such voltage level is within predetermined limits.

4. The system according to claim 3, wherein the first time period is varied within a range from 6 to 12 ms.

5. The system according to claim 1, wherein the control means includes means to produce the first through fourth signals so that the second time period starts before the first time period and ends after the first time period.

6. The system according to claim 5, wherein the control means includes means to detect the voltage level of the direct current source and, when such level is below a predetermined value, to vary the first time period as a function of such voltage level.

7. The system according to claim 6, wherein the control means increases the first time period with decreasing voltage level of the direct current source when such voltage level is within predetermined limits.

8. The system according to claim 7, wherein the first time period is varied within a range from 6 to 12 ms.

9. A system for controlling the spark ignition in an ignition system for an Otto-cycle engine with at least two cylinders, pistons of which simultaneously assume a top dead center position, the system comprising:

a respective ignition element in each cylinder;

at least two ignition coils each with a primary winding and a secondary winding electrically connected to a respective ignition element;

a respective discharging circuit for each ignition coil, comprising the primary winding of such ignition coil and a series-connected circuit breaker element;

a charging circuit having a coil and a series-connected circuit breaker element and including means for connection to a source of direct current;

an ignition capacitor having one end connected to each discharging circuit and another end connected to the charging circuit; and control means for detecting the voltage level of the direct current source and for sending, when the same crankshaft angle close to the top dead center position of the pistons is passed through, respective signals to the above-mentioned circuit breaker element which signals are separate in time and which depend on such voltage level.

10. The system according to claim 9, wherein the control means includes a timing circuit for determining a fixed time for energizing the charging circuit by adjusting timing of respective signals to the circuit breaker element of the charging circuit.

11. The system according to claim 9, wherein the control means includes a microcomputer for operational control of the control means.

12. The system according to claim 9, wherein the control means includes means to detect engine speed and means to enable the control means to send the aforementioned signals only below a predetermined engine speed level.

13. A method of controlling, during engine starting, the spark ignition of ignition elements in at least two cylinders of a multi-cylinder four stroke internal combustion engine, pistons of which cylinders simultaneously assume a top dead center piston and the ignition elements of which cylinders are supplied with energy from a direct current source, comprising the steps of:

determining whether the engine has started, and, if not, then triggering ignition of an ignition element associated with a first of the cylinders with energy from the capacitor;

thereafter initiating recharging of the capacitor from the direct current source;

sensing voltage of the source and continuing recharging of the capacitor for a period of time varying as a function of source voltage, with longer recharging time corresponding to lower battery voltage within predetermined limits of source voltage; and thereafter triggering ignition of an ignition element of a second of the cylinders with energy from the capacitor.

14. The method according to claim 13, wherein the step of determining whether the engine has started comprising measuring engine speed and considering that the engine has started is such speed is above a predetermined value.

15. The method according to claim 14, wherein the step of determining whether the engine has started additionally comprises sensing source voltage and considering that the engine has started if such voltage is above a predetermined value.

16. The method according to claim 14, wherein the time period for capacitor recharging is between 6 and 12 ms.

* * * * *